United States Patent [19]

Molins et al.

[11] 4,040,341

[45] Aug. 9, 1977

[54] APPARATUS FOR MAKING COMPOSITE FILTERS

[75] Inventors: Desmond Walter Molins, London; Norman Walter Jackson, Eastbourne, both of England

[73] Assignee: Molins Limited, England

[21] Appl. No.: 629,622

[22] Filed: Nov. 5, 1975

[30] Foreign Application Priority Data

Nov. 8, 1974 United Kingdom ..... 48399/74

[51] Int. Cl.[2] ..... A24C 5/50

[52] U.S. Cl. ..... 93/77 FT; 198/450

[58] Field of Search ..... 93/1 C, 77 FT; 198/20 C, 450, 448

[56] References Cited

U.S. PATENT DOCUMENTS

| | | | |
|---|---|---|---|
| 3,267,821 | 8/1966 | Rowlands | 93/1 C |
| 3,472,355 | 10/1969 | Menge | 198/20 C X |
| 3,776,343 | 12/1973 | Gouy | 198/20 C |
| 3,834,285 | 9/1974 | Schubert et al. | 93/1 C |
| 3,872,779 | 3/1975 | Jackson | 93/1 C |

*Primary Examiner*—James F. Coan

*Attorney, Agent, or Firm*—Craig & Antonelli

[57] ABSTRACT

Filter material is formed into a continuous rod without wrapping and divided into first filter portions which are then spaced apart whilst moving axially. These first filter portions are intercalated with a stream of spaced second filter portions to form an alternating stream which is then continuously wrapped to produce composite filter rod. The resulting composite filters obtained from this rod include less wrapper material than in conventional construction.

12 Claims, 4 Drawing Figures

Figure 1:
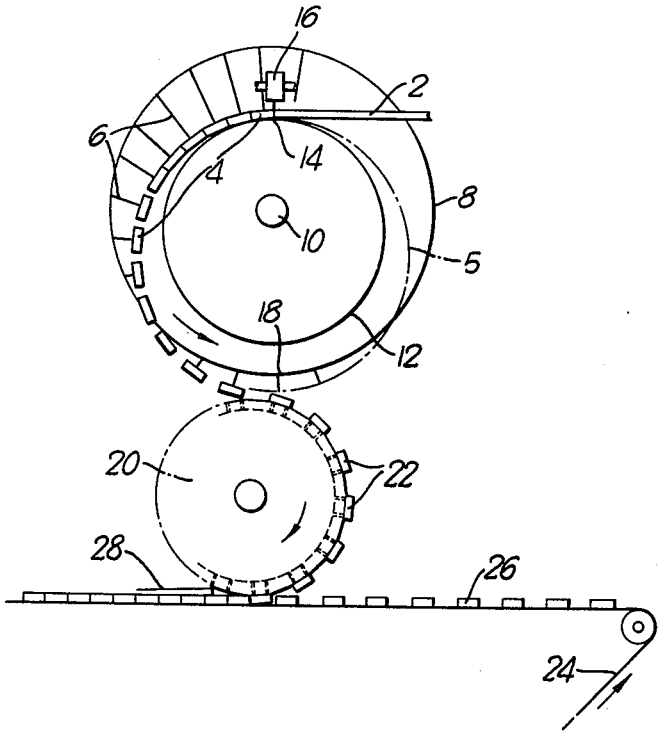

34
40
8
36
62
42
62
58
54
50
56
52
22
6
44
5
64
4
46
8a
12
32
30
46
56
52
54
50
58
48
60
44
38
4
64
62
42
40
6
5
22

134
170
182
158
108
174
162
106
122
164
104
186
154
144
150
184
176
108a
112
130
180
178
144
150
172
184
186
174
138
154
164
182
162
106
182
158
104

APPARATUS FOR MAKING COMPOSITE FILTERS

This invention relates to a method and apparatus for making composite filters for cigaretes or the like.

It is common for cigarettes to consist of a tobacco filler portion and an adjoining mouthpiece portion. Cigarettes of this type will herein be referred to as "filter cigarettes" and mouthpieces will be referred to as "filters," irrespective of the filtering action, if any, which the mouthpiece may perform.

Composite filters are known in which each filter comprises at least two axially adjacent portions. One common construction for a composite filter is a portion consisting of a prewrapped plug of paper-like material and a portion consisting of a prewrapped plug of a tow of cellulose acetate fibres or other suitable fibrous material. In a filter cigarette having this type of filter the paper portion is closest to the tobacco filler. In a conventional method of assembling such filter cigarettes separate machines for "paper" and "tow" produce continuous rods of prewrapped paper and tow respectively. Each rod is cut into double-length portions which are subsequently fed together in an alternating stream into the garniture of a plug combiner where they are enclosed in a continuous wrapper to form a composite filter rod. Finally, the rod is cut at positions corresponding to the mid-points of the double-length portions to produce individual composite filters which are joined to tobacco filler portions in any conventional manner.

One aspect of the present invention provides a method of making composite filters comprising forming a continuous rod of unwrapped filter material and cutting the rod into individual first filter portions, moving said portions in a generally axial direction whilst axially separating them, intercalating said portions with a stream of spaced second filter portions to form an alternating stream, continuously wrapping the alternating stream, and cutting the wrapped stream at predetermined positions to produce composite filters.

The first material may be unwrapped paper-like filter material or a tow of fibrous filter material. The second filter portions could also be formed from an unwrapped rod, or they could be prewrapped plug members. These may be of double-length compared with the corresponding portion in the composite filter. Similarly the first filter portions (i.e. the cut unwrapped rod portions) may be double the length of the corresponding portion in the composite filter. In this case the continuous alternating stream is cut at the mid-points of the respective double-length portions to produce individual composite filters.

Another aspect of the invention provides apparatus for producing composite filters comprising feed means for supplying a continuous rod of unwrapped filter material, cutting means for dividing the rod into into individual first filter portions, means for moving said portions in a generally axial direction and for axially separating them, means for transferring the spaced portions onto a continuous wrapper web, means for feeding onto the web a stream of spaced second filter portions so that the first and second portions intercalate to form a stream of alternating filter portions, means for continuously wrapping the stream in the wrapper web to form a composite filter rod, and means for severing said rod at predetermined positions to produce composite filters or multiples thereof.

The feed means may comprise means for forming the filter material into an unwrapped rod. The means for axially separating the first filter portions may comprise means defining a curved path of increasing radius for said portions. The transferring means may include a suction wheel which receives the spaced first portions and deposits them onto the wrapper web. The stream of spaced second filter portions may be placed on the wrapper web upstream of the point at which the transferring means deposits the first portions onto the web, so that the first portions are placed in the spaces between the second portions.

A further aspect of the invention provides a cigarette filter comprising a portion of first filter material and a portion of second filter material, said portions being in axial alignment and united by an outer wrapper, wherein at least one of said portions has no individual wrapper so that the only wrapping for the filter material of said portion is said outer wrapper. One of said portions may be prewrapped.

Figure 2:
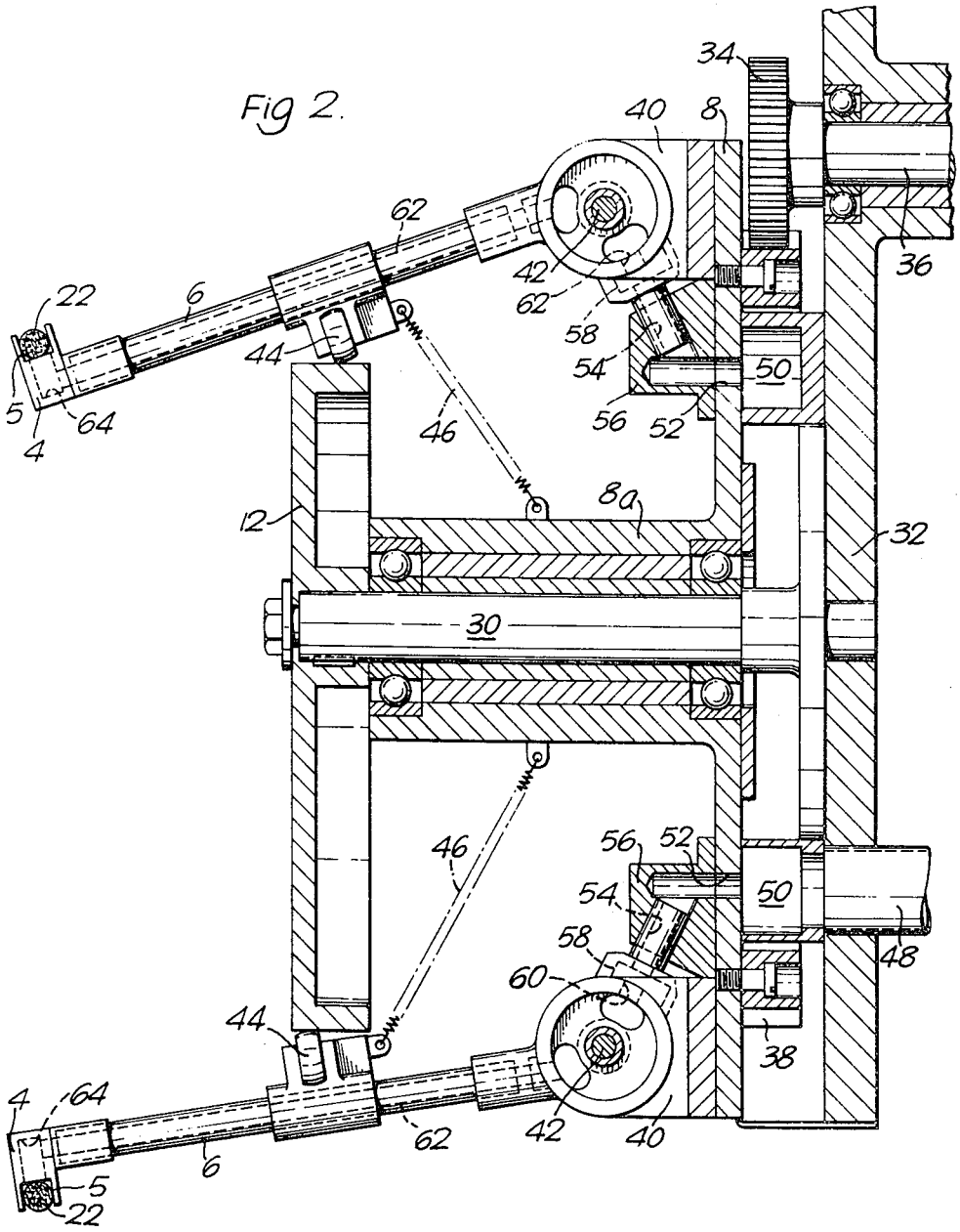
Figure 3:
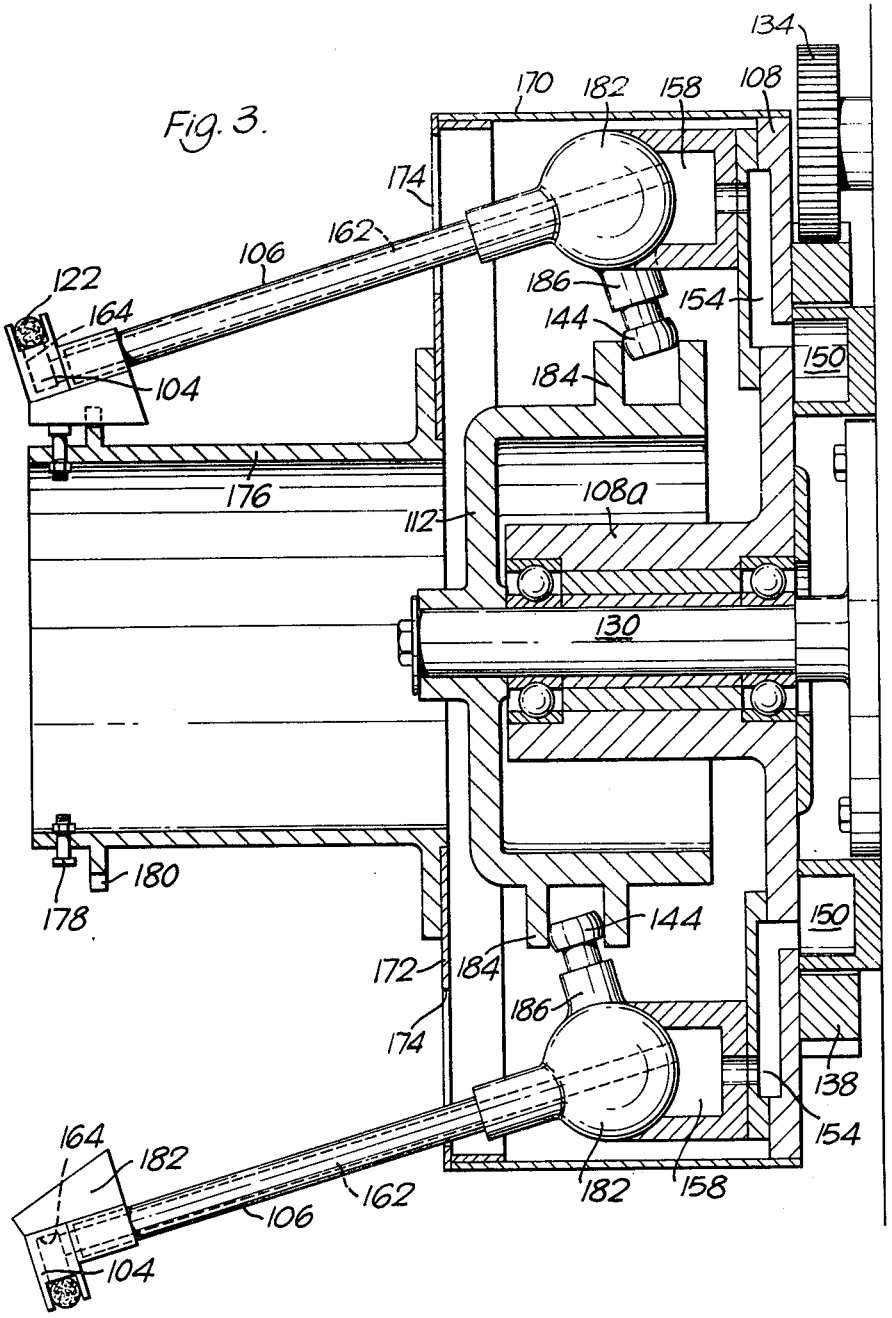
Figure 4:
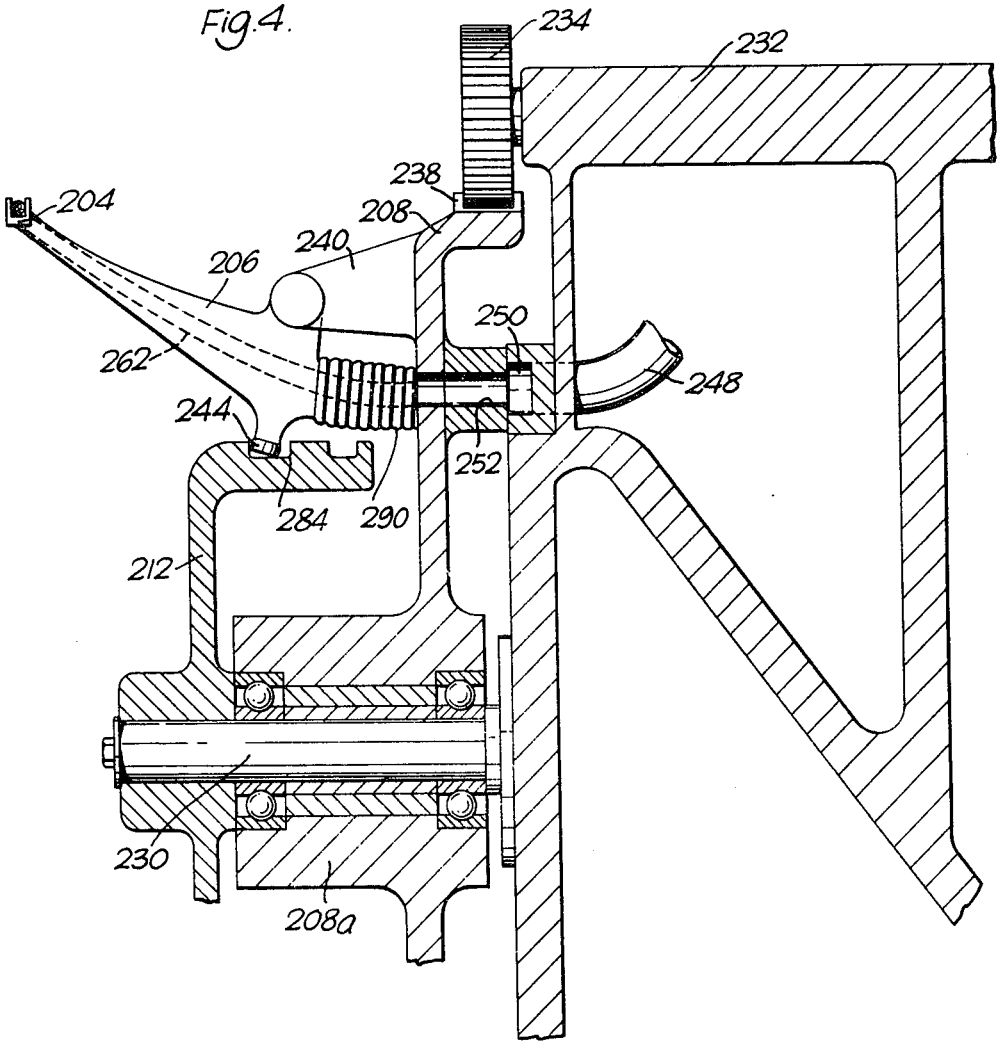

The invention will now be further described, by way of example, with reference to the accompanying drawings in which:

FIG. 1 is a diagrammatic elevation of apparatus for producing composite filters, FIG. 2 is a sectional view of part of the apparatus of FIG. 1, FIG. 3 is a sectional view of a modification of the part shown in FIG. 2, and FIG. 4 is a sectional view of a further modification of the part shown in FIG. 2.

Referring to FIG. 1 an unwrapped rod 2 of filter material, such as laterally compacted or convoluted paper-like material or a tow of cellulose acetate, is fed onto a path defined by a plurality of segments 4 arranged on a closed curve 5 which lies approximately in a first vertical plane. (Although it is convenient here to regard the curve 5 as lying in a single plane it will be apparent from the later description that this is not strictly accurate.) The filter material, which may be supplied from a reel in a flattened form, may be formed into an unwrapped rod 2 by folding members in a garniture. Each segment 4 has means for receiving and holding a portion of the rod. The segments 4 are respectively connected to swinging arms 6 which are pivotally attached to a circular member 8, the axes of pivoting lying in a second vertical plane. The member 8 is rotatable about a horizontal axis 10 and around a stationary cam member 12, which determines the angular positions of the arms 6 and hence defines the curve 5 in a manner to be described hereinafter.

The rod 2 is fed onto the curve 5 at a position 14 corresponding to the curve's minimum radius. A cutting ledger 16 is arranged adjacent the position 14 to cut the rod into individual portions, each of which is received by a segment 4. At the position 14 the segments 4 are very close together, with just sufficient spacing to allow the knife of the ledger 16 to pass between adjacent segments, so that each cut portion of the rod is almost exactly the same length as the peripheral length of a segment. Suction is supplied to the segments 4 so that the rod portions are retained by the segments.

The circular member 8 is rotated in the direction indicated by the arrow in the drawing. As the member 8 rotates, carrying with it the arms 6 and the segments 4, the arms move progressively outwards under the action of the cam member 12. Consequently the segments 4 are gradually spaced apart until, at their position of maximum spacing corresponding to the position 18 at which the curve 5 has maximum radius, the rod portions are released by the segments and transferred to an adjacent suction wheel 20. In order to effect this transfer suction to the segments 4 is shut off in the vicinity of position 18; in addition positive air pressure may be applied to the segments to aid transfer. The rod portions 22 are received on the suction wheel 20 and held in their spaced positions on the wheel by means of suction. The portions 22 are carried by the wheel 20 in the direction indicated by the arrow in the drawing towards a continuous wrapper web 24 which passes adjacent the lower periphery of the wheel 20.

A series of preformed plugs 26 of another filter material is placed on the wrapper web 24 upstream of the wheel 20. The placing of the plugs 26 on the web 24 is timed so that the plugs are spaced by a predetermined amount. The web 24 may be previously glued at appropriate positions so that the plugs 26 are firmly held on the web. The relative spacings of the plugs 26 on the web 24 and the portions 22 on the wheel 20 and their relative positions are such that a portion 22 carried by the wheel 20 is inserted in the gap between adjacent plugs 26 at the lowermost position of the wheel 20. When a portion 22 reaches this position suction from the wheel 20 on that portion is released and the portion is transferred onto the web 24 between the plugs 26. Then a substantially continuous alternating stream of plugs 26 and portions 22 proceeds on the web 24 beyond the transfer point from the wheel 20. This stream passes into a garniture 28 where the wrapper web 24 is continuously wrapped and sealed around the stream to form a composite filter rod. Subsequently the rod is cut at predetermined positions to form composite filters. If each portion 22 and plug 26 is double the respective corresponding length in a composite filter the cut is made at the midpoints of each portion and each plug. In order to form a continuous stream in the garniture it may be necessary to apply slight axial retardation to the members of the stream in order to close up any slight gaps.

Referring now to FIG. 2 the segments 4, swinging arms 6, circular member 8 and cam member 12, and their interrelationship, are shown in more detail. The circular member 8, which comprises a circular disc with an integral sleeve 8*a* is rotatably mounted on a stationary shaft 30 which is attached to a fixed frame member 32. A drive gear 34 connected to a drive shaft 36 rotatably mounted in the frame member 32 is engaged with a ring gear 38 connected to the circular member 8.

At regularly spaced positions around the periphery of the circular member 8 are mounting points 40 for the swinging arms 6. The mounting points 40 allow pivoting of the arms 6 about their respective axes 42. At their ends the arms 6 carry the segments 4, each of which has a curved peripheral channel 5 capable of receiving and holding a rod portion 22. Approximately at their midpoints the arms 6 carry cam rollers 44 which are urged by tension springs 46 into contact with the cam member 12, which is attached to the end of the fixed shaft 30.

A suction pipe 48 leads through the frame member 32 to a part circular suction manifold 50. Suction holes 52 are positioned in the circular member 8 so that they are able to register with the manifold 50. Each hole 52 leads, through passage 54 in a member 56 attached to the opposite face of member 8, to the mounting point 40 for an arm 6. At the end of the passage 54 is en enlarged chamber 58 which remains in register with a passage 60 in the pivoting end of the arm 6 irrespective of the angular position of the arm as determined by cam member 12. The passage 60 leads through the mounting point 40 to an axial bore 62 in the arm 6; the bore 62 is in turn connected to a suction chamber 64 in the segment 4.

In operation the circular member 8 is rotated by the drive gear 34. The arms 6 are moved with the circular member 8 and, since their rollers 44 are maintained in contact with the stationary cam member 12, their angular position relative to their individual axes 42 is determined by their angular position relative to the axis 10 (FIG. 1). As shown in FIG. 2 the upper arm 6 is on a low spot of the cam member 12 and the peripheral dimensions of each segment 4 are such that in this position adjacent segments are very close together. By contrast the lower arm 6 in FIG. 2 is on a high spot of the cam member 12, and since the radius of the curve on which the segments lie is greater at this position, adjacent segments are spaced apart.

Suction is applied to the segments 4 through the manifold 50. Since suction is required only in the region between positions 14 and 18 (in a clockwise sense around axis 10 in FIG. 1) the manifold 50 extends over only this region (and is therefore part-circular). At positions where the holes 52 are not in register with the manifold 50 they are normally exposed to atmospheric pressure. There may however be a further manifold in the region of position 18 to supply air under pressure to the segments 4 to aid transfer of the rod portions 22 to the suction wheel 20.

In FIG. 3, which shows a modification of the apparatus shown in FIG. 2, a part having a function corresponding to a part in FIG. 2 has been given a corresponding reference number increased by 100 and will not necessarily be specifically referred to. The circular member 108, rotatably mounted on stationary shaft 130 and driven through gears 134 and 138, has a peripheral cylindrical extension 170 provided with an annular end plate 172. Radial slots 174 are provided in the end plate 172 through which the swinging arms 106 project. A tube member 176 is connected to the end plate 172 and carries at its outer end locating means for each arm 106 in the form of an adjustable stop 178 and a lateral guide member 180. Each segment 104 is provided with an extension piece 182 for engagement with the corresponding stop 178 and guide member 180. It will be noted that the locating means is effective only at the position of minimum radius of the curved path of the segments 104; this corresponds to the position at which the rod is cut (i.e. equivalent to position 14 in FIG. 1) and is when particular accuracy of location is required.

At its inner end each arm 106 carries a part cylindrical formation 182 by means of which the arm is pivotally mounted and which seals against a suction chamber 158 so that suction can be transmitted to the bore 162. Angular position of each arm 106 relative to its pivoting axis is controlled by a stationary box cam 112 having a guide channel 184 in which the cam roller 144 runs, the roller being attached by means of a short extension 186 to the formation 182.

FIG. 4 shows a further modification of the apparatus of FIG. 2: corresponding parts have reference numbers increased by 200. The circular member 208 is formed with an integral ring gear 238 which is driven by gear 234 rotatably supported in frame 232. Each swinging arm 206 is pivotally mounted on a mounting point 240 and the angular position of the arm is controlled by a cam roller 244 running in a channel 284 in a stationary box cam 212.

Suction is applied through a suction pipe 248 to a manifold 250 and thence through bores 252 in the member 208 to individual flexible bellows units 290 for each arm 206. The bellows units 290 provide a particularly simple and effective means of maintaining the suction connection between the manifold 250 and the axial bore 262 in each arm 206.

Referring now once more to FIG. 1 it is possible that the natural resilience of the rod especially where the filter material of the rod is a fibrous tow, could make it desirable to provide a compression roller adjacent the rod feed to compress the rod onto the segments prior to cutting. The suction zone should in this case be extended so that it is operative immediately the rod comes into contact with a segment. Moreover, since it is desirable that the segments should be close together both at the position of transfer of rod onto the segments and also at the position where the rod is cut, it may be necessary to provide the cam 12 with a flat region so that this situation can be obtained.

It has already been noted that the curve 5 along which the segments 4 move is of varying radius. The peripheral curvature of the segments cannot therefore consistently have a radius corresponding to the radius of the path in which it is moving. One compromise solution is for the peripheral curvature of each segment to have a radius which is equal to the harmonic mean of the maximum and minimum radii of the cure 5.

It will be noted from FIGS. 2 to 4 that the attitude of the segments changes as the swinging arms pivot. It may be desirable for the base of the channel 5 in the segments to remain horizontal, at least in the region of the transfer positions. This may be achieved by use of parallel linkages to maintain the segments in the desired orientation.

As an alternative to the arrangement for separating cut rod portions using swinging arms, radially movable slides could be used. These slides would follow a path similar to that of the curve 5 (but in a single plane, preferably vertical) under the action of cam means. As with the segments the slides would be close together at the point of transfer of rod onto the slides and at the position where the rod is cut but would be spaced apart at the point of transfer to the suction wheel.

The suction wheel may be travelling at a different peripheral speed to that of the segments or slides at the point of transfer so that the spacing between adjacent spaced rod portions is altered after transfer.

Although the invention has been described with reference to the production of rod portions by cutting a continuous rod and then intercalating these portions with prewrapped plugs, composite filters may be produced in an analogous way wherein both components are produced from an unwrapped rod and intercalated on a continuous wrapper web.

We claim:

1. Apparatus for producing composite filters comprising feed means for supplying a serial stream of contiguous first filter elements of predetermined length moving axially along a first path, means for moving said first filter elements received from said feed means transversely along arcuately spaced radial paths for axially separating said first filter elements, conveyor means for supporting a continuous wrapper web, means for feeding onto the web a stream of spaced second filter elements, means for transferring the axially separated first filter elements onto the wrapper web so that said first and second filler elements intercalate to form a stream of alternating filter elements, means for continuously wrapping the stream in the wrapper web to form a composite filter rod, and means for severing said rod at predetermined positions to produce composite filters or multiples thereof.

2. Apparatus as claimed in claim 1 wherein said moving means includes a member rotatable about an axis and a plurality of arms pivoted at one end to said member and having a carrier at the other end thereof for carrying one of said first filter elements.

3. Apparatus as claimed in claim 2 wherein said moving means further includes cam means for biasing said arms outwardly from the axis of said rotatable member as said carriers move from said feed means to said transferring means.

4. Apparatus for producing composite filters comprising feed means for supplying a continuous rod of unwrapped filter material, cutting means for dividing the rod into individual first filter portions, a plurality of cariers for conveying said individual first filter portions, means for moving said carriers so that said portions are conveyed in a generally axial direction and so that said carriers are moved relative to one another to axially separate said portions, conveyor means for supporting a continuous wrapper web, means for transferring the spaced portions onto the wrapper web, means for feeding onto the web a stream of spaced second filter portions so that the first and second portions intercalate to form a stream of alternating filter portions, means for continuously wrapping the stream in the wrapper web to form a composite filter rod, and means for severing said rod at predetermined positions to produce composite filters or multiples thereof.

5. Apparatus as claimed in claim 4 wherein the feed means comprises means for forming the filter material into an unwrapped rod.

6. Apparatus as claimed in claim 4 wherein the moving means causes the first filter portions to travel in a curved path of progressively increasing radius.

7. Apparatus as claimed in claim 6 wherein said moving means includes a member rotatable about an axis and a plurality of arms pivoted to said member, each arm having a carrier adapted to receive a first filter portion and being arranged to move outwards away from said axis as said member is rotated.

8. Apparatus as claimed in claim 4 wherein the transferring means includes a suction wheel which receives the spaced first filter portions and deposits them onto the wrapper web.

9. Apparatus as claimed in claim 4 wherein the means for feeding second filter portions is arranged to place the second filter portions on the wrapper web upstream of the position at which the transferring means deposits the first filter portions onto the web, so that the first filter portions are placed in the spaces between the second filter portions.

10. Apparatus as claimed in claim 4 wherein the moving means includes means for moving said carriers around an axis in a curved path and means for moving said carriers radially relative to said axis.

11. Apparatus for producing composite filters comprising feed means for supplying a continuous rod of unwrapped filter material, cutting means for dividing the rod into individual first filter portions, means for moving said portions in a generally axial direction in a curved path of increasing radius and for axially separating them, said moving means including a member rotatable about an axis and a plurality of arms pivoted to said member, each arm being adapted to receive a first filter portion and being arranged to move outwards away from said axis as said member is rotated, conveyor means for supporting a continuous wrapper web, means for transferring the spaced portions onto the wrapper web, means for feeding onto the web a stream of spaced second filter portions so that the first and second portions intercalate to form a stream of alternating filter portions, means for continuously wrapping the stream in the wrapper web to form a composite filter rod, and means for severing said rod at predetermined positions to produce composite filters or multiples thereof.

12. Apparatus for producing composite filters comprising feed means for supplying a continuous rod of first filter material, cutting means for dividing the rod into individual first filter portions, carrier means for conveying each individual first filter portion in a generally axial direction along a path of gradually increasing radius whereby successive firstfilter portions are axially separated, conveyor means for receiving said spaced first filter portions, means for feeding a stream of spaced second filter portions so that the first and second portions intercalate to form a stream of alternating filter portions on said conveyor means, and means for wrapping said alternating stream to form a composite filter rod.

* * * * *